US008131203B2

(12) United States Patent
Kitan

(10) Patent No.: US 8,131,203 B2
(45) Date of Patent: Mar. 6, 2012

(54) IMAGE FORMING APPARATUS HAVING RETRACTABLE SHEET LOOP DETECTING UNIT

(75) Inventor: Tomonori Kitan, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 595 days.

(21) Appl. No.: 12/276,967

(22) Filed: Nov. 24, 2008

(65) Prior Publication Data

US 2009/0162121 A1 Jun. 25, 2009

(30) Foreign Application Priority Data

Dec. 25, 2007 (JP) ..... 2007-333143

(51) Int. Cl.
*G03G 15/00* (2006.01)

(52) U.S. Cl. ..... 399/400; 399/396; 399/397

(58) Field of Classification Search ..... 399/397, 399/400; 400/579; 270/52.06, 52.15, 58.02, 270/58.03, 58.04; 271/3.13, 4.02, 4.03, 10.02, 271/10.03, 152–154, 227, 259–262
See application file for complete search history.

(56) References Cited

U.S. PATENT DOCUMENTS

| | | | | |
|---|---|---|---|---|
| 5,735,055 | A * | 4/1998 | Hochbein et al. | 33/554 |
| 6,564,025 | B2 * | 5/2003 | Sameshima et al. | 399/68 |
| 7,251,426 | B2 * | 7/2007 | Koshida | 399/68 |
| 7,304,291 | B2 * | 12/2007 | Kawasaki et al. | 250/221 |
| 7,694,964 | B2 * | 4/2010 | Kawasaki et al. | 271/263 |

FOREIGN PATENT DOCUMENTS

JP 07-234604 A 9/1995

* cited by examiner

*Primary Examiner* — Judy Nguyen
*Assistant Examiner* — Justin Olamit
(74) *Attorney, Agent, or Firm* — Canon USA Inc IP Division

(57) ABSTRACT

An image forming apparatus adjusts a size of the loop of the sheet between the fixing unit and the transfer unit, according to a signal from a loop detection unit provided in a sheet conveyance path between a transfer unit and a fixing unit and configured to detect a loop of a sheet. The loop detection unit includes a detecting lever that is provided protrudably and retractably from and into the sheet conveyance path and abuts against the sheet, and a loop detection sensor that is turned on or off by the detecting lever. If the sheet is to be conveyed only by the transfer unit, the detecting lever moves to a retracting position from the sheet conveyance path.

8 Claims, 8 Drawing Sheets

IMAGE FORMING APPARATUS HAVING RETRACTABLE SHEET LOOP DETECTING UNIT

BACKGROUND OF THE INVENTION

1.Field of the Invention

The present invention relates to an image forming apparatus, and more specifically, to an image forming apparatus having a conveyance mechanism for conveying a sheet onto which a toner image has been transferred, while forming a loop between a transfer unit and a fixing unit.

2.Description of the Related Art

Conventionally, in an image forming apparatus employing an electrophotographic process, a toner image formed on an image bearing member is transferred onto a sheet in a transfer unit, and subsequently the sheet is heated in a fixing unit equipped with a fixing roller pair to fix the toner image on the sheet. Further, there is an image forming apparatus which forms images on both sides of the sheet. In this type of an image forming apparatus, a sheet with a toner image formed on its first surface is reversed, and another toner image is transferred and fixed on a second surface of the sheet. Thus, the images are formed on both sides of the sheet.

In such a conventional image forming apparatus, it is possible that when the leading edge of the sheet is entering into a fixing unit, a trailing edge has not yet passed through a transfer unit depending on the length of a sheet. Generally, a sheet conveyance speed of the fixing unit and a sheet conveyance speed of the transfer unit are set to be substantially equal. However, there may appear a difference between sheet conveyance speeds of the fixing unit and the transfer unit due to thermal expansion, individual difference of apparatus parts, or aging of a fixing roller provided in the fixing unit.

When a sheet conveyance speed of the fixing unit is higher than a sheet conveyance speed of the transfer unit, there can occur a phenomenon that a sheet that is bearing unfixed toner image is pulled toward the fixing unit side between the fixing unit and the transfer unit. Such a phenomenon may invite defective transfer and image deterioration. Thus, in order to prevent such a phenomenon that the sheet comes under a tensile stress, a difference of the sheet conveyance speeds is provided between the fixing unit and the transfer unit, so as to warp the sheet that is to be conveyed between the transfer unit and the fixing unit to form a loop.

In the image forming apparatus, heaters are arranged inside heating rollers that constitute a fixing roller pair, and temperature control of the heater is performed during the fixing process of a toner image. Owing to the temperature control, a surface of the heating roller is held at a predetermined fixing temperature. It is known that quality of an image on a sheet varies depending on heat quantity and pressure energy received from the fixing roller pair. Therefore, image quality and gloss are more likely to be affected in a color image because a large amount of toner adheres to the sheet due to heat quantity and pressure energy received from the fixing roller pair, compared with a black and white image to which a small amount of toner adheres.

For example, when an image forming operation is executed in succession, the fixing process of the next sheet may be started while the energy lost by a fixing process of a prior sheet has not yet been sufficiently recovered and the temperature of the heating roller is still low. Such a variation of heat quantity may have an influence on image quality on a sheet. For example, image quality may change among images on one piece of sheet, or image quality of each sheet may be different with each other even when the similar images are formed in succession. To address such a problem, electric power supplied to the heater is increased (i.e., heater capacity is increased) so that supplied energy and consumed energy become balanced as viewed over a relatively longer period of time. However, if materials with low thermal responsiveness such as heat-resistant rubber are used on the surface of the heating roller to enhance image quality, the temperature of the heating roller may drop.

Thus, when temperature on the heating roller changes, the change in temperature causes a change in outer diameter of the heating roller, so that a conveyance speed of the sheet passing through a fixing roller pair also is changed. In addition, a conveyance speed of the sheet varies depending on difference in heat capacity of the sheet, in other words, depending on whether the sheet is thin or thick, or overhead projector (OHP) sheet. Thus, if a sheet conveyance speed of the fixing roller pair varies, it becomes difficult to form and maintain a stable loop between the transfer unit and the fixing unit, particularly in an apparatus in which the length of a sheet conveyance path for guiding the sheet between the transfer unit and the fixing unit is set short.

Further, if a sheet conveyance speed in the fixing unit (the fixing roller pair) is slower than a sheet conveyance speed in the transfer unit, an excessive loop will be formed. If such an excessive loop is formed, the sheet comes into contact with a conveyance guide that constitutes the sheet conveyance path, thus causing poor images and transfer noises (irregularities of images caused at the time of transfer). In order to solve such a problem, Japanese Patent Application Laid-Open No. 07-234604 discusses a technique to detect a size of a loop of a sheet formed between a transfer unit and a fixing unit, and to increase/decrease a sheet conveyance speed of a fixing roller pair depending on a size of the loop.

FIG. 8 is a view illustrating a configuration of a transfer unit and a fixing unit of the conventional image forming apparatus. The configuration includes a transfer unit 113 and a fixing unit 105 equipped with a fixing roller pair having a heating roller 105*a* and a pressure roller 105*b*. In a sheet conveyance path 120 between the transfer unit 113 and the fixing unit 105, a detecting lever 150 is arranged. The detecting lever 150 is arranged such that when a loop is formed on a sheet P, the detecting lever rotates around a rotating shaft 151 being pressed by the sheet P, and a sensor S is turned on/off by the rotation of the detecting lever 150.

Thus, the sensor S detects the rotation of the detecting lever 150 and determines that the loop of the sheet P has reached a predetermined size. According to the determination, a sheet conveyance speed attained by the fixing roller pair (105*a* and 105*b*) of the fixing unit 105 is controlled. For example, when the sensor S determines that the loop has reached a predetermined size, the size of the loop is decreased by increasing a sheet conveyance speed of the fixing roller pair (105*a* and 105*b*). In contrast, if the sensor S ceases to detect the rotation of the detecting lever 150, the sensor S determines that the size of loop has become too small, and then the size of loop is increased by reducing a sheet conveyance speed of the fixing roller pair (105*a* and 105*b*). Thereby, the size of the loop of the sheet P can be maintained within a predetermined range and can be stabilized.

In such a conventional image forming apparatus, a toner image on a sheet is unfixed between the transfer unit and the fixing unit, and it is necessary to convey the sheet while forming the loop in the sheet that is being conveyed. Accordingly, a spacing between a guide 122 at an image surface side and a guide 121 at a non-image surface side that constitute the sheet conveyance path 120 is set wide. However, if a spacing between the guides 121 and 122 is thus made wide, a conveyance track of the sheet P will be disturbed when the sheet P abuts against the detecting lever 150 while the sheet P is pinched and conveyed only by one of the fixing unit 105 and the transfer unit 113.

For example, when the sheet P is conveyed while a leading edge of a sheet has not yet reached the fixing unit 105, the sheet P is pinched and conveyed only by the transfer unit 113, which brings about an unstable state. If the detecting lever 150 abuts against the sheet P in that state, the sheet P may be distorted. In particular, if the sheet P has a low rigidity, this phenomenon occurs remarkably. Then, when a sheet's leading edge enters into a nip portion of the fixing roller pair 105*a* and 105 while the sheet P is distorted, timing of sheet entry into the nip portion of the fixing roller pair 105*a* and 105*b*, may be shifted in a width direction orthogonal to a sheet conveying direction. If the timing of the entry is thus shifted, the sheet P is skewed, which causes distortion of a toner image which is to be transferred in the transfer unit 113.

On the other hand, after a sheet's trailing edge has come out of the transfer unit 113, the sheet P is pinched and conveyed only by the fixing roller pair 105*a* and 105*b*, which brings about an unstable state. Under this state, if the detecting lever 150 is situated in a retracting position from the sheet conveyance path 120 under pressure of the warped sheet P, the sheet's trailing edge may be pressed by a backwards reaction force of the detecting lever 150 toward the guide 122 at an image surface side and abuts against the guide 122. If the sheet's trailing edge portion abuts against the guide 122 at the image surface side in this manner, yet-unfixed toner image flies off, an attitude of the sheet at the fixing unit 105 changes, and thus uneven fixation of images can occur in that portion. As a result, image quality deteriorates, and a stable image cannot be formed.

SUMMARY OF THE INVENTION

The present invention is directed to an image forming apparatus that can stabilize a conveyance of a sheet between a transfer unit and a fixing unit, and can prevent the deterioration of image quality.

According to an aspect of the present invention, the image forming apparatus includes a transfer unit configured to transfer a toner image formed at the image forming unit to a sheet, a fixing unit configured to fix the toner image that has been transferred by the transfer unit to the sheet, a sheet conveyance path, provided between the transfer unit and the fixing unit, guiding the sheet onto which a toner image has been transferred by the transfer unit, to the fixing unit, and a loop detection unit configured to detect a loop formed on the sheet in the sheet conveyance path. A difference of the sheet conveyance speeds between the transfer unit and the fixing unit is adjusted according to a signal from the loop detection unit. The loop detection unit includes a detecting member, provided protrudably and retractably in the sheet conveyance path, configured to movable by pressure received from the sheet to be conveyed, a detection sensor configured to detect the detecting member, a movement mechanism configured to move the detecting member to protrudably and retractably from and into the sheet conveyance path, and a control unit configured to control an operation of the movement mechanism, so as to move the detecting member to a retracting position from the sheet conveyance path, until a leading edge of the sheet conveyed by the transfer unit reaches the fixing unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
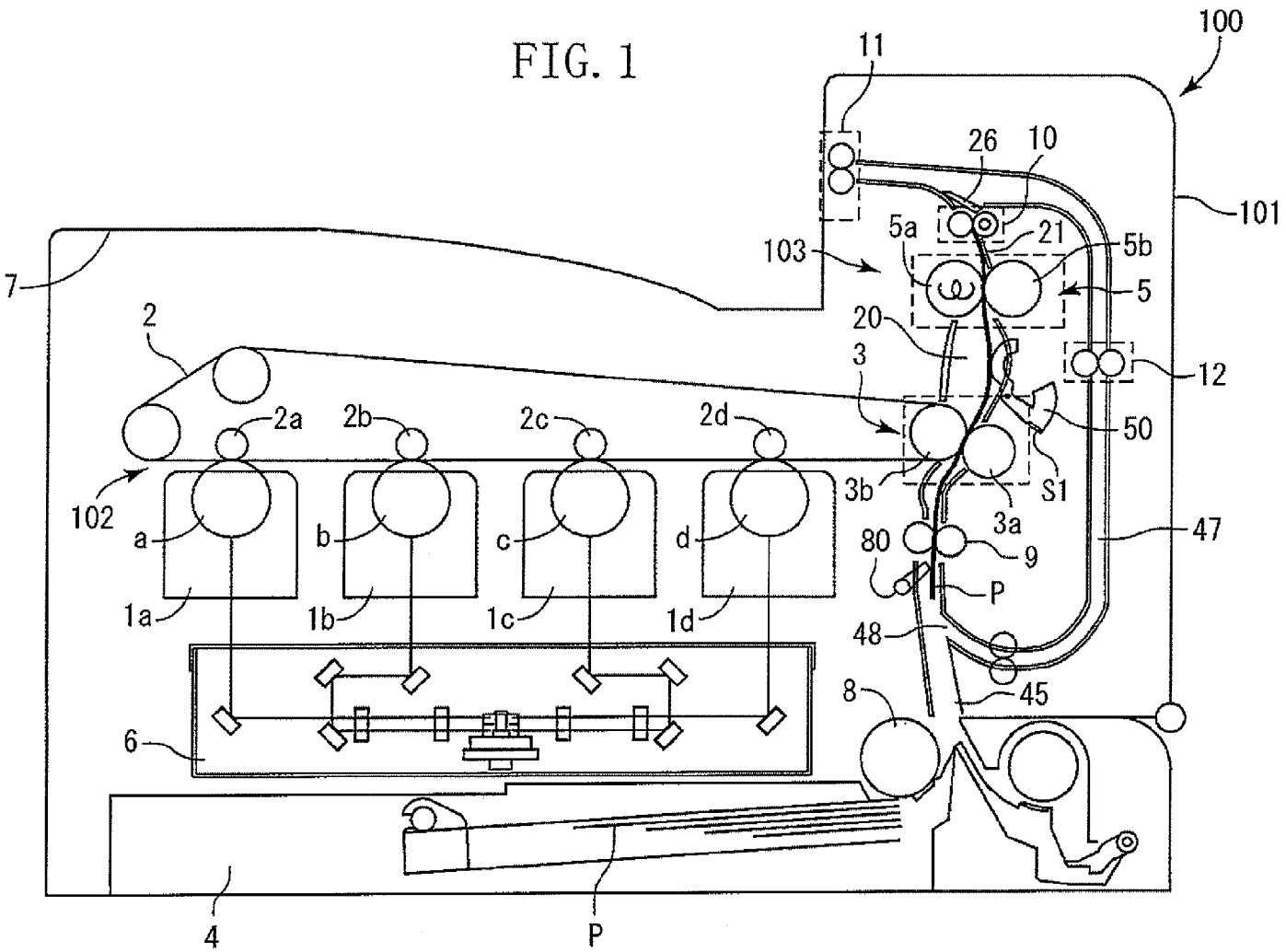
FIG. 1 is a view illustrating a configuration of an image forming apparatus according to an exemplary embodiment of the present invention.

FIG. 1 is a view illustrating a configuration of an image forming apparatus 100 according to an exemplary embodiment of the present invention. The image forming apparatus 100 includes an image forming apparatus main body (hereinafter referred to as an apparatus main body) 101, an image forming unit 102 for forming an image on a sheet P, and a fixing unit 5. The fixing unit 5 includes a fixing roller pair including a heating roller 5*a* and a pressure roller 5*b*. The image forming unit 102 includes photosensitive drums a to d for forming four-color toner images of yellow, magenta, cyan, and black, and an exposure device 6 for irradiating the drums with a laser beam according to image information to form electrostatic latent images on the photosensitive drums a to d. The photosensitive drums a to d are driven by motors (not shown). Around the photosensitive drums a to d, a primary charger, a developing device, and a transfer charger (not shown) are arranged respectively, and these components are unitized as process cartridges 1*a* to 1*d*.

An intermediate transfer belt 2 is driven and rotated in the direction of an arrow. Toner images in respective colors on the photosensitive drums a to d are multiply-transferred in succession onto the intermediate transfer belt 2 by applying a transfer bias to the intermediate transfer belt 2 by transfer chargers 2*a* to 2*d*.Thus, full-color images are formed on the intermediate transfer belt 2. A secondary transfer unit 3 transfers full-color images successively formed on the intermediate transfer belt 2 onto the sheet P. The secondary transfer unit 3 includes a secondary transfer counter roller 3*b* for supporting the intermediate transfer belt 2, and a secondary transfer roller 3*a* that abuts against the secondary transfer counter roller 3*b* across the intermediate transfer belt 2.

The sheet conveyance device 103 is provided at a downstream of the fixing unit 5 to convey the sheet P on which an image has been fixed by the fixing unit 5. The sheet conveyance device 103 includes a changeover member 26, a sheet discharge conveyance roller pair 10, forwardly and reversely rotatable discharge roller pair 11, and a guide 21. The changeover member 26 is configured to discharge the sheet P, on which an image has been fixed by the fixing unit 5, onto a sheet discharge tray 7. The guide 21 guides the sheet from the fixing unit 5 to the sheet discharge conveyance roller pair 10. A registration entrance detection sensor 80 is provided at an upstream of a registration roller 9 and the secondary transfer unit 3 in a sheet conveying direction.

Next, an image forming operation of the image forming apparatus 100 thus configured will be described. When an image forming operation is started, firstly the exposure device 6 irradiates with a laser beam according to image information from a personal computer (not shown), exposes in succession the surfaces of photosensitive drums a to d that are uniformly charged at a predetermined polarity/potential to form electrostatic latent images on the photosensitive drums a to d. After that, the electrostatic latent images are developed and visualized with a toner. For example, the exposure device 6 firstly irradiates a photosensitive drum a with a laser beam according to an image signal of a yellow component color of an original via a polygon mirror, to form a yellow electrostatic latent image on the photosensitive drum a. Then, this yellow electrostatic latent image is developed with a yellow toner in a developing device and visualized as a yellow toner image.

Next, when this toner image reaches a primary transfer unit where the photosensitive drum a and the intermediate transfer belt 2 abut against each other along with the rotation of the photosensitive drum a, the yellow toner image on the photosensitive drum a is transferred onto the intermediate transfer belt 2 by a primary transfer bias that is applied by the transfer charger 2*a* (primary transfer).

Next, when a portion bearing the yellow toner image of the intermediate transfer belt 2 is moved, a magenta toner image that has been formed up to this point on the photosensitive drum b will be transferred in a similar method to the above onto the yellow toner image on the intermediate transfer belt 2. Similarly, as the intermediate transfer belt 2 moves on, a cyan toner image and a black toner image are transferred and superimposed on the yellow toner image and the magenta toner image in the primary transfer unit, respectively. Thus, full-color toner images are formed on the intermediate transfer belt 2. In addition, concurrently with the toner image forming operation, sheets P stored in a paper supply cassette 4 is fed one by one by a pick-up roller 8 and reaches the registration roller 9 via a sheet conveyance path 45. Then, the sheet P is conveyed to the secondary transfer unit 3 after timing has been synchronized by the registration roller 9. Then, four-color toner images on the intermediate transfer belt 2 are collectively transferred onto the sheet P by a secondary transfer bias applied to the secondary transfer roller 3*a* in the secondary transfer unit 3 (secondary transfer).

Next, the sheet P onto which toner images have been transferred is conveyed to the fixing unit 5 guided by a sheet conveyance path 20 provided between the secondary transfer unit 3 and the fixing unit 5. Then, by receiving heat and pressure from a fixing roller pair (5*a* and 5*b*) provided in the fixing unit 5, respective color toners are fused and mixed, and then fixed as full-color images on the sheet P. After that, the sheet P on which images have been thus fixed is discharged onto the sheet discharge tray 7 by the sheet discharge conveyance roller pair 10 and the discharge roller pair 11 provided at a downstream of the fixing unit 5.

The image forming apparatus 100 is capable of forming two-sided images, and conveys, during the two-sided image formation, the sheet P to a duplex conveyance path 47 by the reverse rotation of the discharge roller pair 11 and the changeover of the changeover member 26. Subsequently, the sheet P is conveyed by a conveyance roller pair 12 provided in the duplex conveyance path 47, and is re-fed to the registration roller 9 by way of a merging portion 48. Then, toner images are formed by the image forming operation similar to the image formation of the first side.

Figure 2:
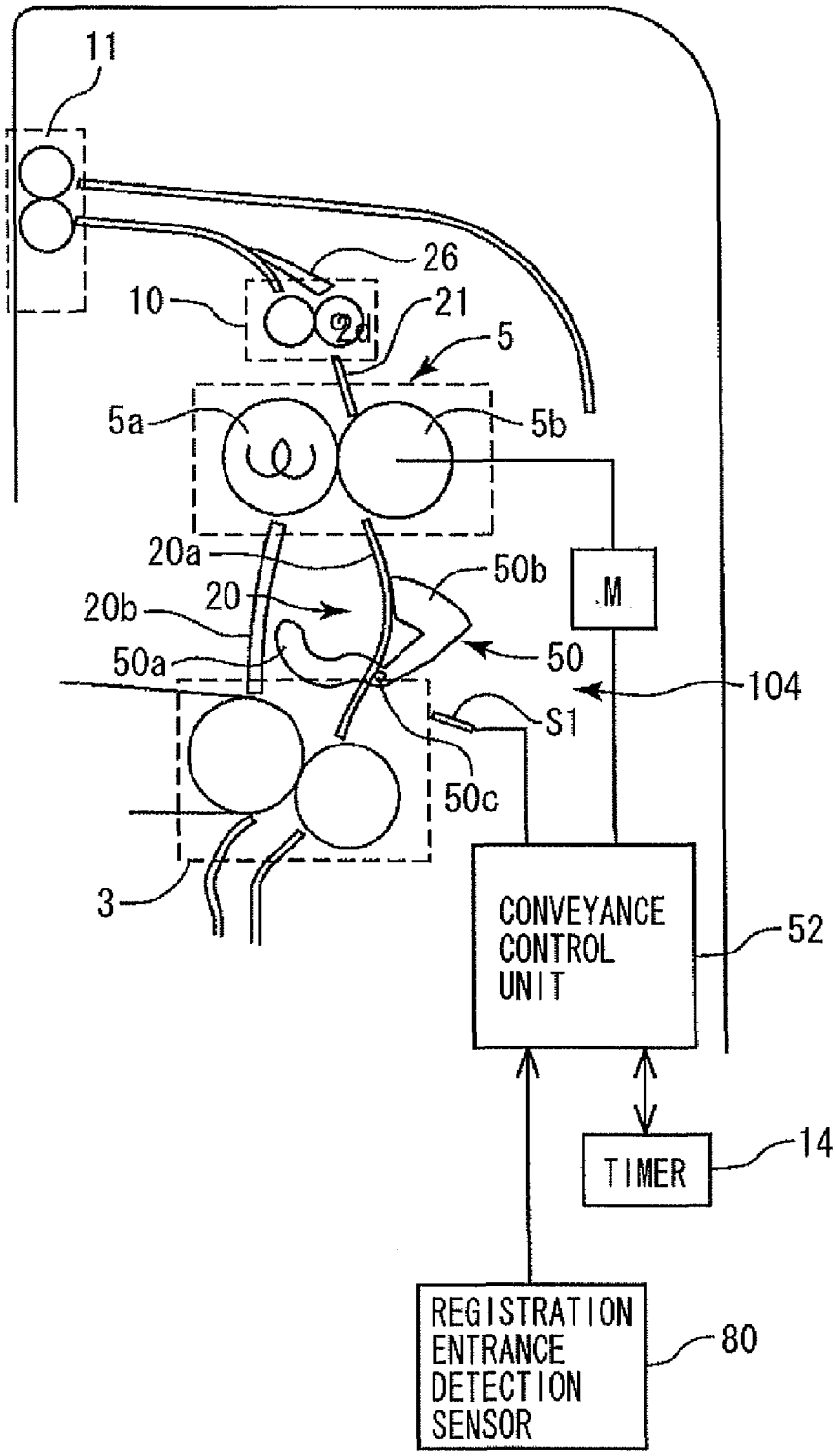
FIG. 2 is a view describing a configuration in a vicinity of a secondary transfer unit and a fixing unit of an image forming apparatus.

In the present exemplary embodiment, when conveying the sheet P from the secondary transfer unit 3 toward the fixing unit 5, a loop is formed on the sheet P and the size of loop is adjusted so as to prevent defective transfer and image deterioration. In order to thus adjust the size of the sheet loop, a loop detection unit 104 is provided between the secondary transfer unit 3 and the fixing unit 5, as illustrated in FIG. 2. The loop detection unit 104 includes a detecting lever 50, serving as a detecting member, rotatable by pressure of the warp of the sheet, in the sheet conveyance path 20 between the secondary transfer unit 3 and the fixing unit 5, as illustrated in FIG. 2. The loop detection unit 104 further includes a loop detection sensor S1 that is turned on/off by the rotation of the detecting lever 50. The sheet conveyance path 20 has a guide 20*a* at a non-image surface side, and a guide 20*b* at an image surface side.

The detecting lever 50 is provided protrudably and retractably in the sheet conveyance path 20. The detecting lever 50 is pressed by the warped sheet P, when the sheet P is warped to form a loop, so as to rotate around the rotating shaft 50*c*.The loop detection sensor S1 detects the rotation of the detecting lever 50 pressed by the warped sheet P. Thus, a conveyance control unit 52 detects a loop of the sheet P, and controls a sheet conveyance speed of the fixing unit 5.

Figure 3A:
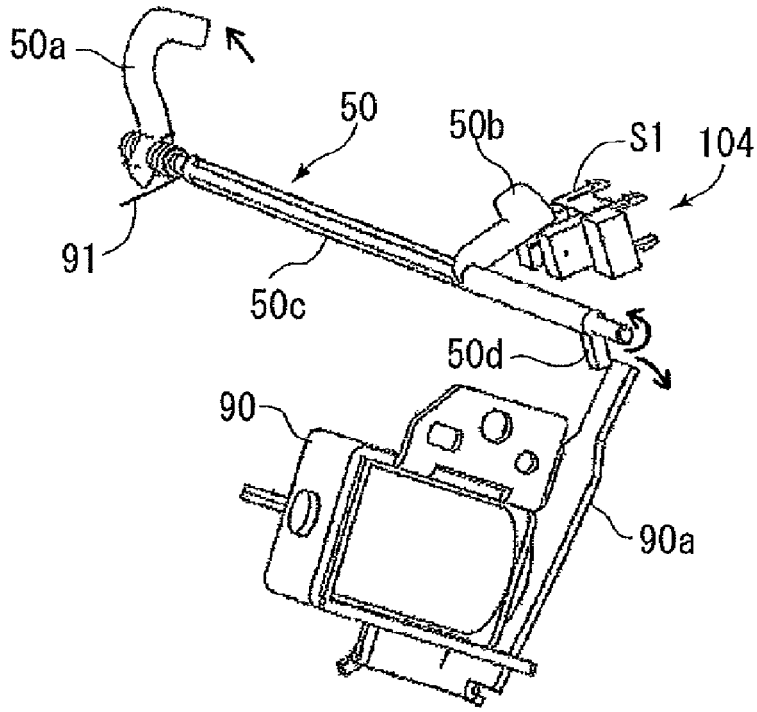
FIGS. 3A and 3B are perspective views illustrating a configuration of a loop detection unit provided in the image forming apparatus.
Figure 3B:
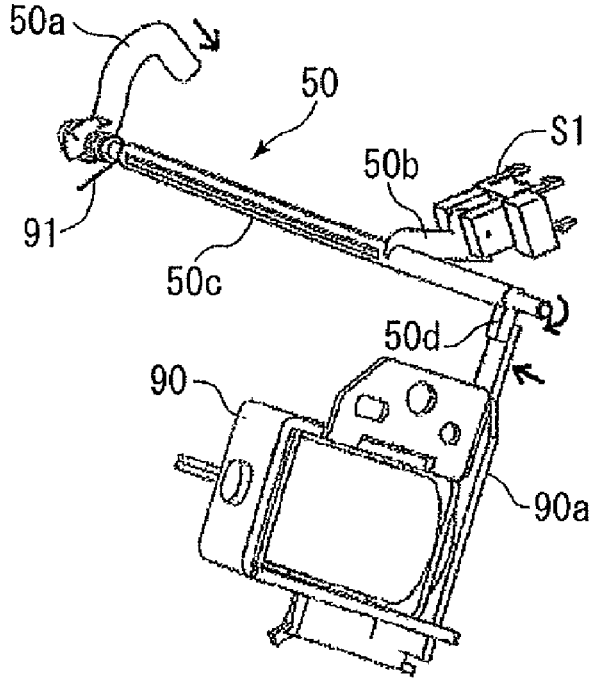

FIGS. 3A and 3B are views illustrating configurations of the loop detection unit 104 that include the detecting lever 50, and the loop detection sensor S1 capable of detecting the detecting lever 50. A conveyance control unit 52 determines the size of a loop of the sheet P according to a detection signal from the loop detection unit 104. As illustrated in FIGS. 3A and 3B, the detecting lever 50 includes an abutting portion 50*a* and a light shielding unit 50*b*.The abutting portion 50*a* is provided in one end of the rotating shaft 50*c* and abuts against the leading edge of the sheet P. The light shielding unit 50*b* is provided on the rotating shaft 50*c* with a phase shifted relative to the abutting portion 50*a* and shields (ON) the loop detection sensor S1 from light. FIG. 3A illustrates a state when the abutting portion 50*a* of the detecting lever 50 protrudes to the sheet conveyance path 20 (loop detection status). FIG. 3B illustrates a state when the abutting portion 50*a* of the detecting lever 50 has retracted from the sheet conveyance path 20. The two states are set by the movement mechanism.

The movement mechanism will be described with reference to FIGS. 3A and 3B. When a solenoid 90 is turned on, an oscillating plate 90*a* of the solenoid 90 moves from a position as illustrated in FIG. 3A in a direction of the arrow as illustrated in FIG. 3B. Then, when moving in the direction of the arrow, the oscillating plate 90*a* abuts against a projection portion 50*d* provided on the rotating shaft 50*c* of the detecting lever 50 to move the projection portion 50*d*. Thus, the rotating shaft 50*c* rotates in the direction of the arrow as illustrated in FIG. 3B. Along with the rotation, the abutting portion 50*a* of the detecting lever 50 moves to a retracting position from the sheet conveyance path 20. Namely, in the present exemplary embodiment, the solenoid 90 is designed to cause the detecting lever 50 to selectively move to a position where the abutting portion 50*a* retracts from the sheet conveyance path 20, or a position where the abutting portion 50*a* protrudes into the sheet conveyance path 20.

A return spring 91 serving as a twist spring mounted on the rotating shaft 50*c*, usually urges the detecting lever 50 in the direction that the abutting portion 50*a* protrudes into the sheet conveyance path 20. When the solenoid 90 is turned off, and the oscillating plate 90*a* moves from a position as illustrated in FIG. 3B in the direction of the arrow as illustrated in FIG. 3A, the return spring 91 causes the rotating shaft 50*c* to move in the direction of the arrow as illustrated in FIG. 3A. Along with this movement, the detecting lever 50 moves to a position where the abutting portion 50*a* protrudes into the sheet conveyance path 20.

In FIG. 2, a fixing motor M drives the fixing roller pair 5*a* and 5*b* independently of another conveyance roller pair. A signal from the loop detection sensor S1 is input to the conveyance control unit 52. The conveyance control unit 52 controls the number of revolutions of the fixing motor M according to the signal from the loop detection sensor S1. In addition, the conveyance control unit 52 controls the solenoid 90 to selectively move the detecting lever 50 to a position for retracting from the sheet conveyance path 20, or a position for protruding into the sheet conveyance path 20. The conveyance control unit 52 is connected to the registration entrance detection sensor 80 and a signal detected by the registration entrance detection sensor 80 is input to the conveyance control unit 52. In addition, the conveyance control unit 52 is also connected to a timer 14.

Figure 4:
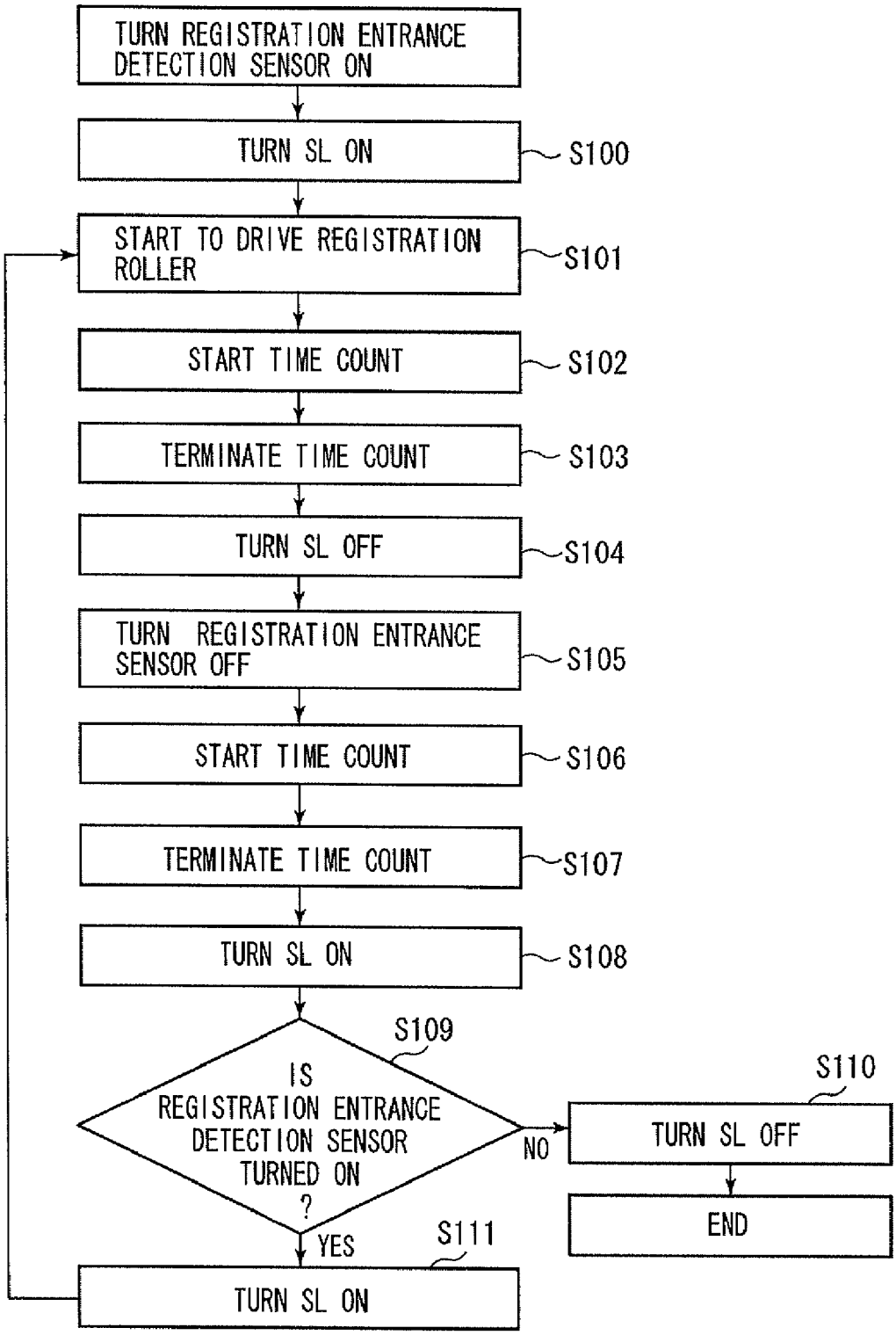
FIG. 4 is a flowchart illustrating a sheet conveyance operation in a sheet conveyance device provided in the image forming apparatus.
Figure 5A:
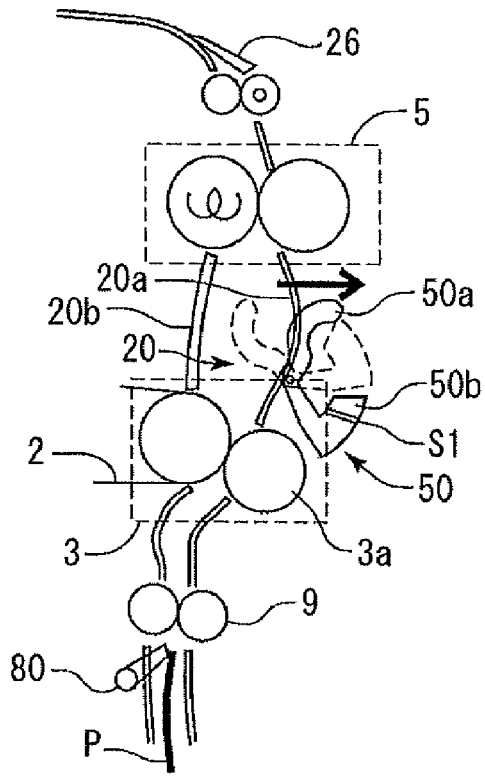
FIGS. 5A and 5B are views illustrating a sheet conveyance operation in the sheet conveyance device provided in the image forming apparatus.
Figure 5B:
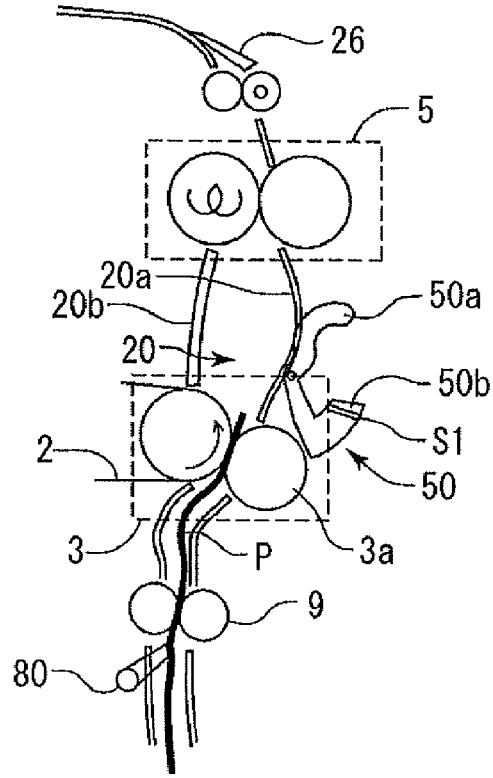

Next, a sheet conveying operation between the secondary transfer unit 3 and the fixing unit 5 having such a configuration will be described with reference to a flowchart, as illustrated in FIG. 4 and the views in FIGS. 5A to 7. A sheet P that has been fed one by one from a paper supply cassette 4 is, as illustrated in FIG. 5A, first detected by the registration entrance detection sensor 80. Then, when the registration entrance detection sensor 80 that has detected the sheet P is turned on, in step S100, the conveyance control unit 52 activates (ON) the solenoid (SL) 90 according to a sheet detection signal (ON signal) from the registration entrance detection sensor 80. As a consequence, the oscillating plate 90*a* of the solenoid 90 moves in the direction of the arrow as illustrated in FIG. 3B to cause the rotating shaft 50*c* to rotate with a projection portion 50*d* of the detecting lever 50. Along with this rotation, the detecting lever 50 rotates in the direction of the arrow as illustrated in FIG. 5A, and thus the abutting portion 50*a* retracts from the sheet conveyance path 20 (a state as illustrated in FIG. 5B).

Next, the conveyance control unit 52 causes the sheet P to hit a stopped registration roller 9 so that the sheet P is stopped for a while. After that, in step S101, the conveyance control unit 52 starts to drive the registration roller 9 in synchronization with the image forming unit 102 and conveys the sheet P toward the secondary transfer unit 3. When the sheet P reaches the secondary transfer unit 3, four-color toner images on an intermediate transfer belt 2 will be collectively transferred onto the sheet P with a secondary transfer bias applied to a secondary transfer roller 3*a*. When driving the registration roller 9, in step S102, the conveyance control unit 52 causes the timer 14, as illustrated in FIG. 2, to start counting. The timer 14 has been set to count a time required for the sheet P to reach a nip portion of the fixing roller pair 5*a* and 5*b* starting from the registration roller 9. To the counted time, some allowance is added.

Next, after having thus transferred four-color toner images onto the sheet P in the secondary transfer unit 3, the conveyance control unit 52 performs control to convey the sheet P toward the fixing unit 5. At this time, the abutting portion 50*a* of the detecting lever 50 has already retracted from the sheet conveyance path 20, as illustrated in FIG. 5B. Accordingly, even if the sheet P is in an unstable conveying state in which the leading edge of the sheet P has not yet reached the fixing roller pair 5*a* and 5*b*, the sheet P passes therethrough without coming into contact with the detecting lever 50, so that the sheet P reaches the nip portion of the fixing roller pair 5*a* and 5*b* with the same timing in a width direction without getting distorted.

Until the leading edge of the sheet P reaches the fixing unit 5, the conveyance control unit 52 reduces in advance the rotational speed of the fixing motor M, and sets the sheet conveyance speed of the fixing roller pair 5*a* and 5*b* to a sheet conveyance speed Vfl which is slower than the sheet conveyance speed of the secondary transfer roller 3*a*. In addition, during the period that elapses before the sheet P reaches the nip portion of the fixing roller pair 5*a* and 5*b*, the loop detection sensor S1 is shielded by a light shielding portion 50*b* that has moved to a retraction position. However, the conveyance control unit 52 disables a sensor detection signal while the solenoid 90 is operated.

Figure 6A:
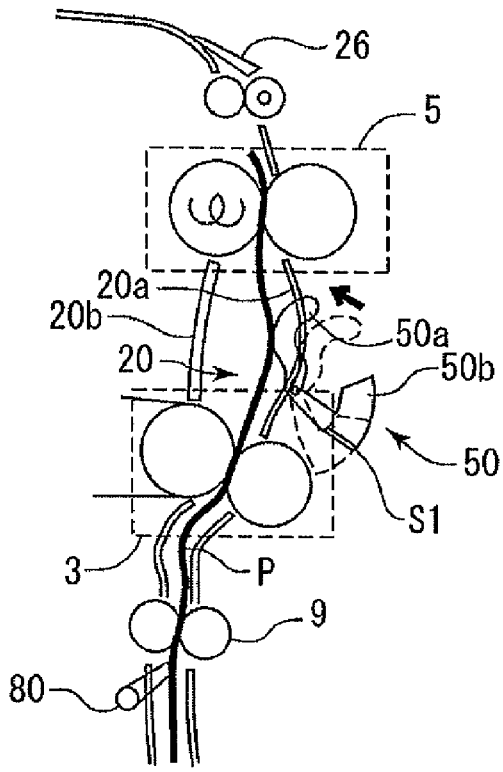
FIGS. 6A and 6B are views illustrating a sheet conveyance operation in the sheet conveyance device provided in the image forming apparatus.

Next, after the sheet P has reached the fixing roller pair 5*a* and 5*b*, in step S103, the counting of the timer 14 terminates. Then in step S104, the conveyance control unit 52 turns the solenoid (SL) 90 off. As a consequence, the detecting lever 50 is rotated in the direction of the arrow by the reaction force of a return spring 91 mounted on the rotating shaft to abut against the sheet P, as illustrated in FIG. 6A. In other words, the retraction state of the detecting lever 50 is released. At this moment, the sheet P has already plunged into the nip portion of the fixing roller pair 5*a* and 5*b*. In addition, the fixing roller pair 5*a* and 5*b* attains a sheet conveyance speed Vfl that is slower than the secondary transfer roller 3*a*, so that the loop of sheet P is enlarged. Accordingly, the abutting portion 50*a* of the detecting lever 50 comes into contact with the sheet P by a slight amount of rotation.

Thus, in the present exemplary embodiment, after the sheet P has reached the nip portion of the fixing roller pair 5*a* and 5*b*, the detecting lever 50 abuts against the sheet P. Therefore, when the leading edge of the sheet P is in an unstable state, the detecting lever 50 can prevent the leading edge of the sheet P from inclining, and the sheet P can be stably conveyed to the fixing roller pair 5*a* and 5*b*. On the other hand, after the detecting lever 50 has thus abutted against the sheet P, if a loop of the sheet P increases due to difference between sheet conveyance speeds of the fixing roller pair 5*a* and 5*b* and the secondary transfer roller 3*a*, the detecting lever 50 is pressed by the sheet P. Accordingly, the detecting lever 50 rotates as illustrated in FIG. 6B, and due to this rotation, the loop detection sensor S1 is shielded by the light shielding portion 50*b*, and a detection signal Sh is sent from the loop detection sensor S1 to the conveyance control unit 52.

The conveyance control unit 52 switches a rotational speed of the fixing motor M according to the detection signal Sh from the loop detection sensor S1, so as to attain a sheet conveyance speed Vfh that is faster than the sheet conveyance speed of the secondary transfer roller 3*a*. Thus, when the rotational speed of the fixing motor M is switched and a sheet conveyance speed Vfh is attained, the difference between the sheet conveyance speeds of the fixing roller pair 5*a* and 5*b* and the secondary transfer roller 3*a* becomes small, and a loop of the sheet P becomes gradually small. Since the detecting lever 50 is urged to contact the sheet P, it is rotated more toward the sheet conveyance path 20 side as the loop becomes smaller. Due to this rotation, the light shielding portion 50*b* goes away from the loop detection sensor S1, thus ceasing to shield the loop detection sensor S1 (OFF) and eventually, the output of the detection signal Sh disappears. Then, when the detected signal Sh thus ceases to be output, the conveyance control unit 52 switches the sheet conveyance speed of the fixing roller pair 5*a* and 5*b* to Vfl that is slower than Vfh. By repeating this operation, the sheet P can be stably conveyed without introducing tensile stress between the secondary transfer unit 3 and the fixing unit 5, even in a long sheet, while maintaining the size of loop within a given range.

Figure 6B:
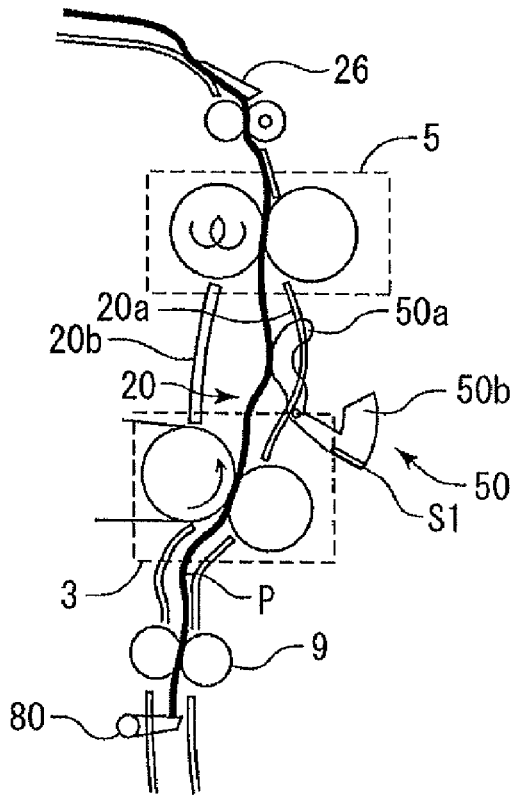
Figure 7:
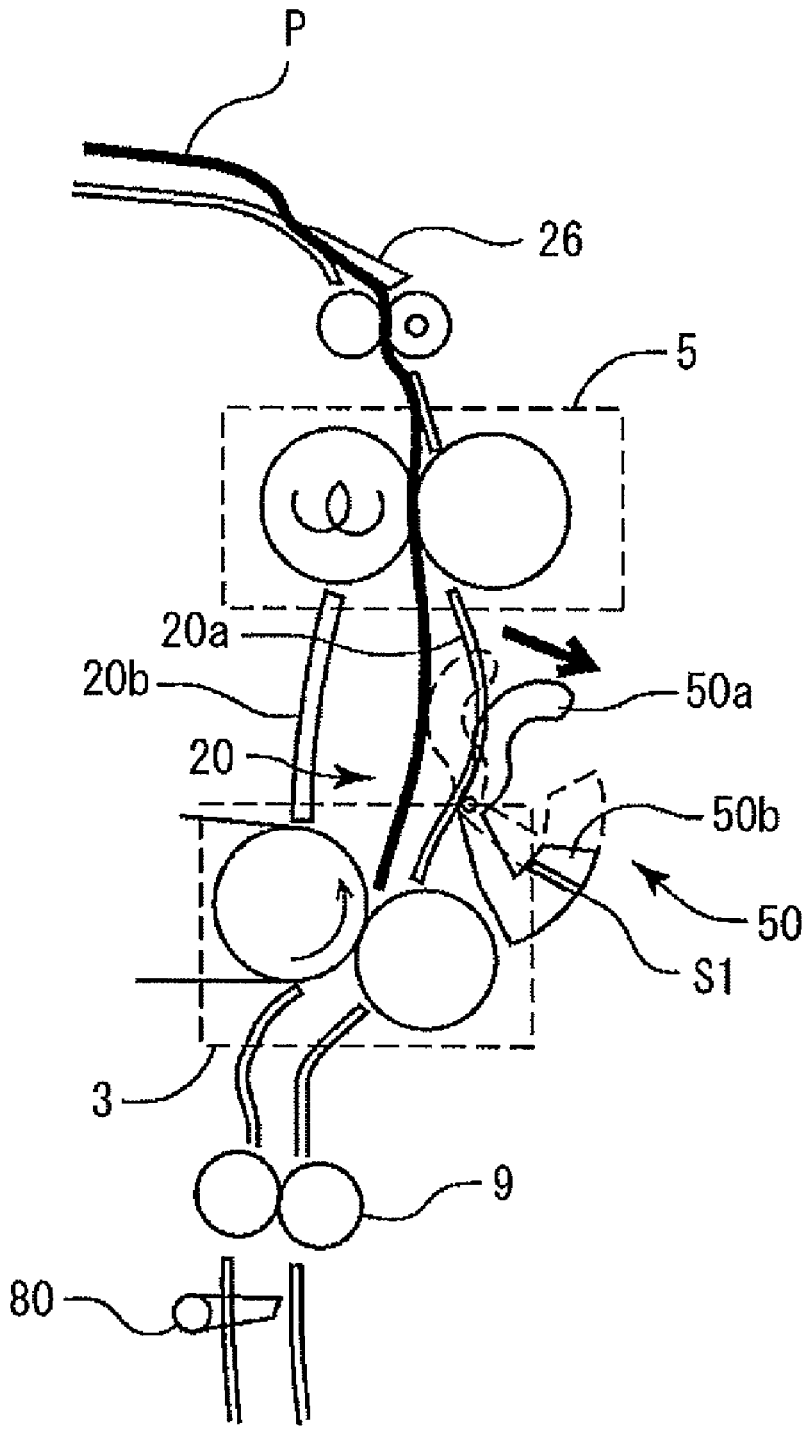
FIG. 7 is a view illustrating a sheet conveyance operation in a sheet conveyance device provided in the image forming apparatus.
Figure 8:
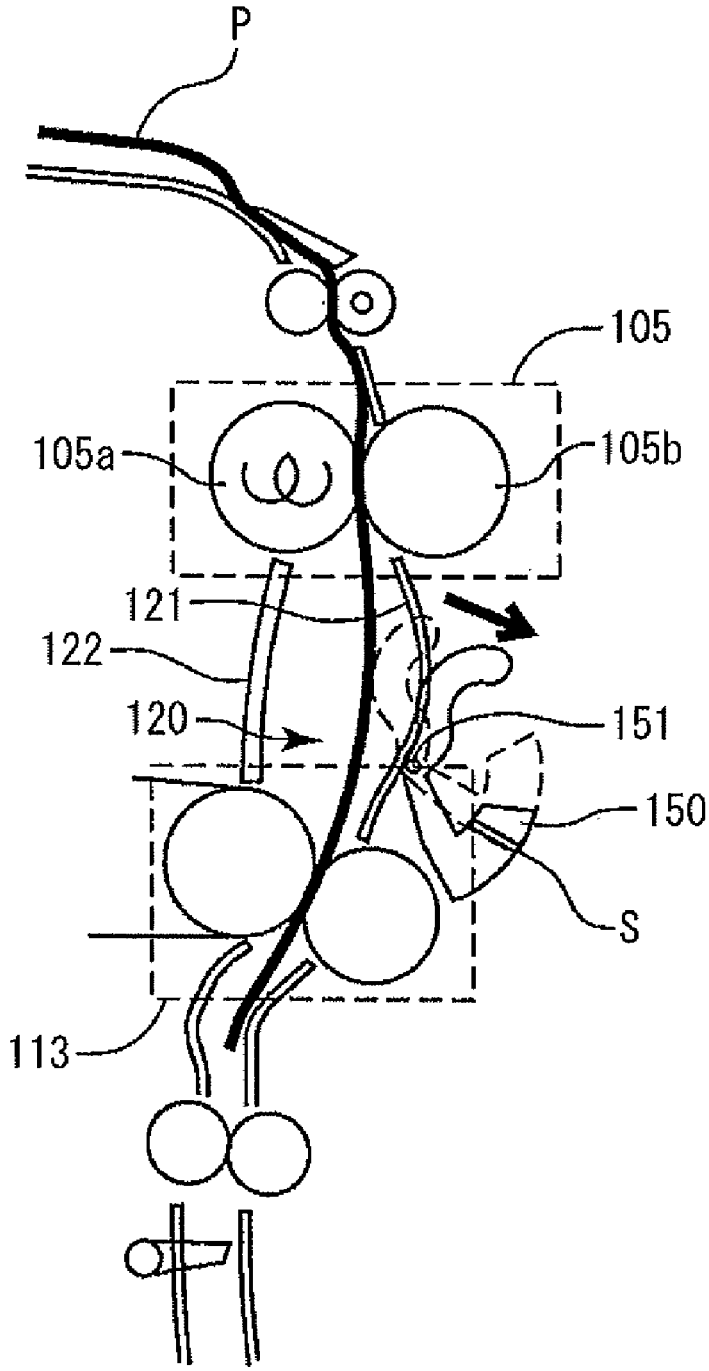
FIG. 8 PRIOR ART
FIG. 8 is a view describing a configuration in the vicinity of a transfer unit and a fixing unit of a conventional image forming apparatus.

Next, as illustrated in FIGS. 6B to 7, the trailing edge of the sheet P comes out from the registration entrance detection sensor 80, then in step S105, the registration entrance detection sensor 80 is turned off. Then in step S106, the conveyance control unit 52 causes the timer 14 to start counting. The counting time of the timer 14 at this moment is set to a value a little shorter than the time from when the trailing edge of the sheet P comes out of the registration entrance detection sensor 80 till the trailing edge comes out of the nip of the secondary transfer unit 3.

When, in step S107, the counting of the timer 14 terminates, then in step S108, the conveyance control unit 52 activates (ON) the solenoid 90 at the same time. As a consequence, the detecting lever 50 rotates in the direction of the arrow, as illustrated in FIG. 7, and due to this rotation, the abutting portion 50*a* of the detecting lever 50 retracts from the sheet conveyance path 20 to get away from the sheet P. Immediately after the above process, the sheet P comes out of the secondary transfer unit 3 and is supported only by the fixing roller pair 5*a* and 5*b* so that the conveyance of the sheet P tends to become unstable. However, in this case, since the detecting lever 50 has already retracted, it never pushes away or rejects the sheet P, so that the sheet P can be stably conveyed. Accordingly, unevenness of fixation or irregularity of yet-unfixed images can be prevented.

After the above process, if the image forming operation still continues, in step S109, the conveyance control unit 52 determines whether the registration entrance detection sensor 80 is turned ON or OFF. If the registration entrance detection sensor 80 is turned ON (YES in step S109), then in step S111, the conveyance control unit 52 turns the solenoid 90 on as it is, and performs the processes in steps after S101 as previously described. On the other hand, if the registration entrance detection sensor 80 is turned OFF (NO in step S109), in step S110, the conveyance control unit 52 turns the solenoid 90 off and terminates the image forming operation.

Thus, in the present exemplary embodiment, until the sheet's leading edge reaches the fixing roller pair (5*a*,5*b*), and when the sheet P is conveyed only by the fixing roller pair 5*a* and 5*b*, the detecting lever 50 is moved to a position where the abutting portion 50*a* retracts from the sheet conveyance path 20. In other words, when either one of the secondary transfer unit 3 and the fixing unit 5 conveys the sheet P, the detecting lever 50 is moved to a retracting position from the sheet conveyance path 20. Accordingly, irregularity of conveyance attitude of the sheet, which is associated with loop control, can be reduced and stable images can be formed.

Note that depending on a guide structure between the transfer unit and the fixing unit of the image forming apparatus, it may not be always necessary to retract the detecting lever in both cases where the sheet is conveyed only by the secondary transfer unit 3 and the sheet is conveyed only by the fixing unit 5. In these cases, it is necessary to retract the detecting lever 50 only when the sheet P is conveyed only on a necessary side (the transfer unit or the fixing unit).

In the description of the exemplary embodiment up to this point, the control of sheet conveyance speed of the fixing roller pair 5*a* and 5*b* has been performed by the conveyance control unit 52, but the present invention is not limited to this embodiment. For example, the control of sheet conveyance speed of the fixing roller pair 5*a* and 5*b* may be performed by a control unit (not shown) for controlling the entire image forming operation of the apparatus main body 101.

Additionally, a retraction position of the detecting lever 50 is, in the present exemplary embodiment, set at a position where the detecting lever 50 does not protrude into the sheet conveyance path 20 side beyond a guide 20*a*.However, the detecting lever 50 may retract protruding into the sheet conveyance path 20 as long as it has no influence upon the conveyance of the sheet P.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-333143 filed on Dec. 25, 2007, which is hereby incorporated by reference herein in its entirety.

What is claimed is:

1. An image forming apparatus comprising:

a transfer unit configured to transfer a toner image that has been formed by an image forming unit to a sheet;

a fixing unit configured to fix the toner image that has been transferred by the transfer unit to the sheet;

a sheet conveyance path, provided between the transfer unit and the fixing unit, guiding the sheet onto which toner image has been transferred by the transfer unit to the fixing unit; and a loop detection unit configured to detect a loop formed on the sheet in the sheet conveyance path, wherein a difference of sheet conveyance speeds between the transfer unit and the fixing unit is adjusted according to a signal from the loop detection unit, and the loop detection unit includes:

a detecting member, provided protrudably and retractably in the sheet conveyance path, configured to be movable by pressure received from the sheet to be conveyed;

a detection sensor configured to detect the detecting member;

a movement mechanism configured to move the detecting member protrudably and retractably into and from the sheet conveyance path; and a control unit configured to control an operation of the movement mechanism, wherein the control unit controls, until a leading edge of the sheet conveyed by the transfer unit reaches the fixing unit, the movement mechanism to move the detecting member to a retracting position from the sheet conveyance path so as not to abut against the sheet, and after the leading edge of the sheet reaching the fixing unit, the movement mechanism to move the detecting member to a protruding position into the sheet conveyance path to be movable by pressure received from the sheet.

2. The image forming apparatus according to claim 1, wherein the control unit controls, when a sheet is conveyed only by the fixing unit, the movement mechanism to move the detecting member to a retracting position from the sheet conveyance path.

3. The image forming apparatus according to claim 1, further comprising a sheet detection unit, provided upstream of the transfer unit in a sheet conveying direction, configured to detect a sheet, wherein the control unit controls the movement mechanism according to information from the sheet detection unit.

4. The image forming apparatus according to claim 1, wherein the control unit sets, until a sheet's leading edge reaches the fixing unit, a sheet conveyance speed of the fixing unit at a speed slower than a sheet conveyance speed of the transfer unit, and the control unit controls, after a sheet's leading edge has reached the fixing unit, a sheet conveyance speed of the fixing unit according to detection by the detection sensor.

5. An image forming apparatus comprising:

a transfer unit configured to transfer a toner image that has been formed by an image forming unit to a sheet;

a fixing unit configured to fix the toner image that has been transferred by the transfer unit to the sheet;

a sheet conveyance path, provided between the transfer unit and the fixing unit, guiding the sheet onto which toner image has been transferred by the transfer unit to the fixing unit; and a loop detection unit configured to detect a loop formed on the sheet in the sheet conveyance path, wherein a difference of sheet conveyance speeds between the transfer unit and the fixing unit is adjusted according to a signal from the loop detection unit, and the loop detection unit includes:

a detecting member, provided protrudably and retractably in the sheet conveyance path, configured to be movable by pressure received from the sheet to be conveyed;

a detection sensor configured to detect the detecting member;

a movement mechanism configured to move the detecting member protrudably and retractably into and from the sheet conveyance path; and a control unit configured to control an operation of the movement mechanism, wherein the control unit controls, when a sheet is conveyed only by the fixing unit after the sheet is conveyed by both the transfer unit and the fixing unit, the movement mechanism to move the detecting member to a retracting position from the sheet conveyance path so as not to abut against the sheet.

6. The image forming apparatus according to claim 5, wherein the control unit controls, until a leading edge of the sheet conveyed by the transfer unit reaches the fixing unit, the movement mechanism to move the detecting member to a retracting position from the sheet conveyance path.

7. The image forming apparatus according to claim 5, further comprising a sheet detection unit, provided upstream of the transfer unit in a sheet conveying direction, configured to detect a sheet, wherein the control unit controls the movement mechanism according to information from the sheet detection unit.

8. The image forming apparatus according to claim 5, wherein the control unit sets, until a sheet's leading edge reaches the fixing unit, a sheet conveyance speed of the fixing unit at a speed slower than a sheet conveyance speed of the transfer unit, and the control unit controls, after a sheet's leading edge has reached the fixing unit, a sheet conveyance speed of the fixing unit according to detection by the detection sensor.

* * * * *